US006932620B2

(12) United States Patent
Ishiguro et al.

(10) Patent No.: US 6,932,620 B2
(45) Date of Patent: Aug. 23, 2005

(54) CONTACT ARRANGEMENT

(75) Inventors: Yozo Ishiguro, Toyota (JP); Takehiro Nomura, Toyota (JP); Shinya Iwanaga, Toyota (JP); Hideaki Tanaka, Okazaki (JP); Seigen Maeno, Okazaki (JP); Naoki Kushima, Kobe (JP)

(73) Assignees: Kojima Press Industry Co., Ltd., Aichi-ken (JP); Fujitsu Ten Limited, Hyogo-ken (JP)

( * ) Notice: Subject to any disclaimer, the term of this patent is extended or adjusted under 35 U.S.C. 154(b) by 0 days.

(21) Appl. No.: 10/997,414

(22) Filed: Nov. 22, 2004

(65) Prior Publication Data

US 2005/0118744 A1 Jun. 2, 2005

(30) Foreign Application Priority Data

Nov. 28, 2003 (JP) ..... 2003-400475

(51) Int. Cl.[7] ..... H01R 12/00
(52) U.S. Cl. ..... 439/66; 439/700; 439/824
(58) Field of Search ..... 439/66, 700, 824, 439/289, 74

(56) References Cited

U.S. PATENT DOCUMENTS 3,308,420 A * 3/1967 Fitz Gerald ..... 439/700
4,072,384 A * 2/1978 Moore ..... 439/700
4,588,938 A * 5/1986 Liautaud et al. ..... 439/700
5,154,628 A * 10/1992 Skegin ..... 439/700
6,494,748 B1 * 12/2002 Mori et al. ..... 439/700
6,716,043 B2 * 4/2004 Ishizuka ..... 439/700

FOREIGN PATENT DOCUMENTS

| | | |
|---|---|---|
| JP | HEI 3-39258 | 4/1991 |
| JP | HEI 4-88690 | 7/1992 |
| JP | HEI 4-105462 | 9/1992 |

* cited by examiner

*Primary Examiner*—Tho D. Ta
(74) *Attorney, Agent, or Firm*—Ganz Law, PC; Bradley M. Ganz

(57) ABSTRACT

An elastic member made of a metallic conductor is installed inside a main body. A contact head made of a conductor is pressed by a force exerted from the elastic member against an object to be contacted. The contact head is connected to a wire constituting a part of an electric conduction path. An insulator for breaking electric continuity between the elastic member and the contact head is inserted between the elastic member and the contact head. In addition to establishing electrical continuity with the object to be contacted using the wire and the contact head rather than the elastic member, the elastic member is insulated from the contact head and placed apart from the contact head to suppress parasitic capacitance between the elastic member and the contact head.

5 Claims, 9 Drawing Sheets

CONTACT ARRANGEMENT

The disclosure of Japanese Patent Application No. 2003-400475 including specification, claims, drawings and abstract is incorporated herein by reference in its entirety.

BACKGROUND OF THE INVENTION

1. Field of the Invention

The present invention relates to a contact arrangement configured such that an elastic member presses a contact member against an object to be contacted.

2. Description of the Related Art

FIG. 9 shows a conventional probe connector 70 which is used in a connecting area when electrical connection between print substrates is desired. The probe connector 70 shown in FIG. 9 comprises a stationary part 74 fixed onto a component 72 constituting one side of contact, a movable contactor 76 made of a conductor and movably housed in the stationary part 74, and a spring 78 made of a conductor and movably housed in the stationary part 74. The movable contactor 76 is brought into contact with a contact point of a component 80 constituting the other side of contact by a force exerted from the spring 78. The spring 78, the movable contactor 76, and the stationary part 74 establish an electric conduction path to bring electric continuity between the two components 72 and 80, specifically, between conductor patterns 72*a* and 80*a* provided on the components 72 and 80, respectively. This type of contact arrangement has an advantage in that a wiring task for electrically connecting two components can be omitted, and the contact arrangement is particularly effective in connecting two components when the distance between the two components varies, or when there is part-to-part variation in dimensions. Japanese Utility-Model Laid-Open Publication No. Hei 4-88690, for example, discloses one known example for such a probe connector, but there is no description regarding applicability of the probe connector to a contact arrangement for an antenna or for a vehicle. For the reasons described, the above-described technology is not readily or easily applied to a contact arrangement for an antenna or for a vehicle.

Further, in the prior-art contact arrangement such as described above, a coil spring is typically used as a part of the electric conduction path, but this leads to problematic situations in which, for example, the inductance of the coil spring causes transmission loss to increase in high-frequency signal transfer.

In the related-art contact arrangement, the spring may be placed near a ground electrode. One problem which often arises when the spring is placed in such a manner is that the strength of a signal decreases in a certain frequency band due to a parasitic capacitance existing between the spring and the ground electrode.

SUMMARY OF THE INVENTION

In view of the aforesaid problems, the present invention provides a contact arrangement which advantageously increases transmission characteristics. A contact arrangement for a high-frequency circuit according to this invention comprises a main body, an elastic member made of a metallic conductor and installed inside the main body, a contact head made of a conductor and pressed against an object to be contacted by a force exerted from the elastic member, an insulator inserted between the elastic member and the contact head to break electric continuity between the elastic member and the contact head, and a wire connected to the contact head to constitute a part of an electric conduction path. In addition to establishing electric conduction between the contact arrangement and the object to be contacted by the wire and the contact head rather than the elastic member, the elastic member is insulated from the contact head and placed apart from the contact head to suppress parasitic capacitance existing between the elastic member and the contact head.

In one aspect of the present invention, an arm or a cavity is formed to the insulator to provide a gap between the elastic member and the contact head. In another aspect of the present invention, the contact arrangement further comprises a metallic lead inserted between the insulator and the contact head to be electrically continuous with the contact head, and including an arm for wiring which extends outward along a direction intersecting an axial direction of the elastic member. Further, according this aspect, the wire may be connected to the arm for wiring at a place located outer than side edges of the contact head and the elastic member.

In still another aspect of the present invention, a contact arrangement used for an antenna for a vehicle window comprises a main body, an elastic member made of a metallic conductor and installed inside the main body, a contact head made of a conductor and pressed against an contacting area of an antenna element attached to the vehicle window by a force exerted from the elastic member, an insulator inserted between the elastic member and the contact head to break electric continuity between the elastic member and the contact head, and a wire connected to the contact head to constitute a part of the electric conduction path. In addition to establishing electrical continuity with the contacting area of the antenna element by the wire and the contact head rather than the elastic member, the elastic member is insulated from the contact head and placed apart from the contact head, to thereby suppress parasitic capacitance existing between the elastic member and the contact head.

BRIEF DESCRIPTION OF THE DRAWINGS

A preferred embodiment of the present invention will be described in detail based on the following figures, wherein.

DESCRIPTION OF THE PREFERRED EMBODIMENT

Figure 1:
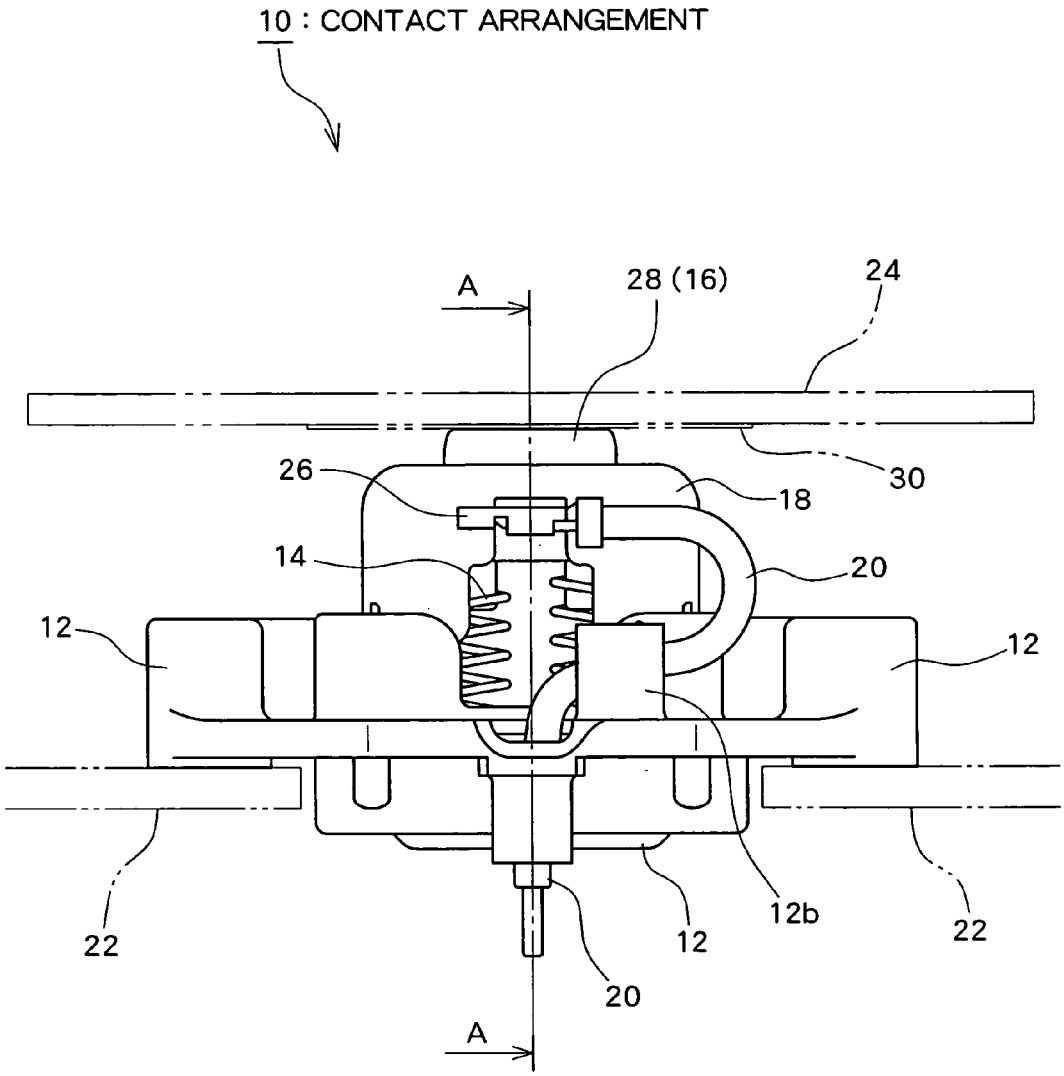
FIG. 1 is an external view showing an example structure of a main part of a contact arrangement according to an embodiment of the present invention.
Figure 2:
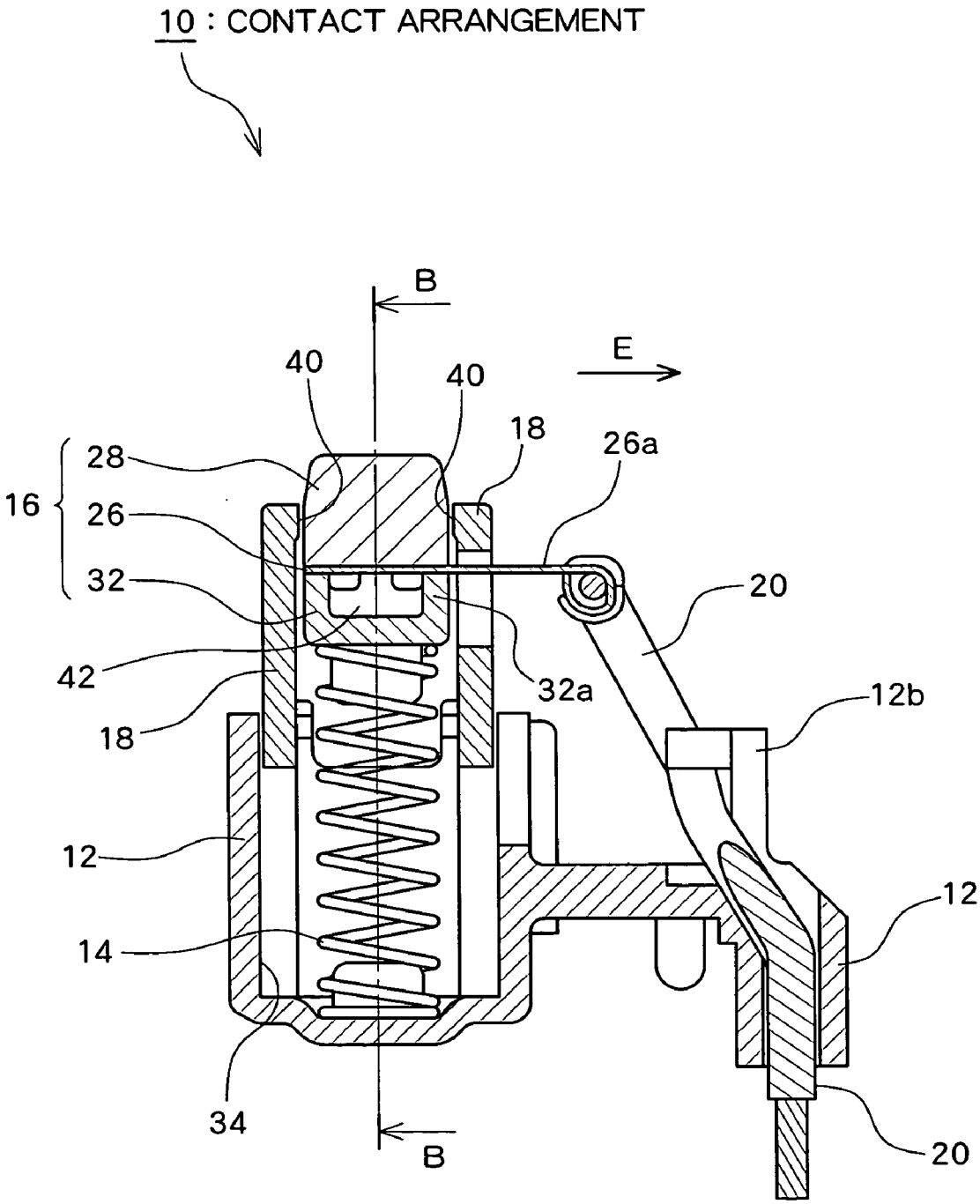
FIG. 2 is a sectional view of the contact arrangement taken along the line A—A of FIG. 1.
Figure 3:
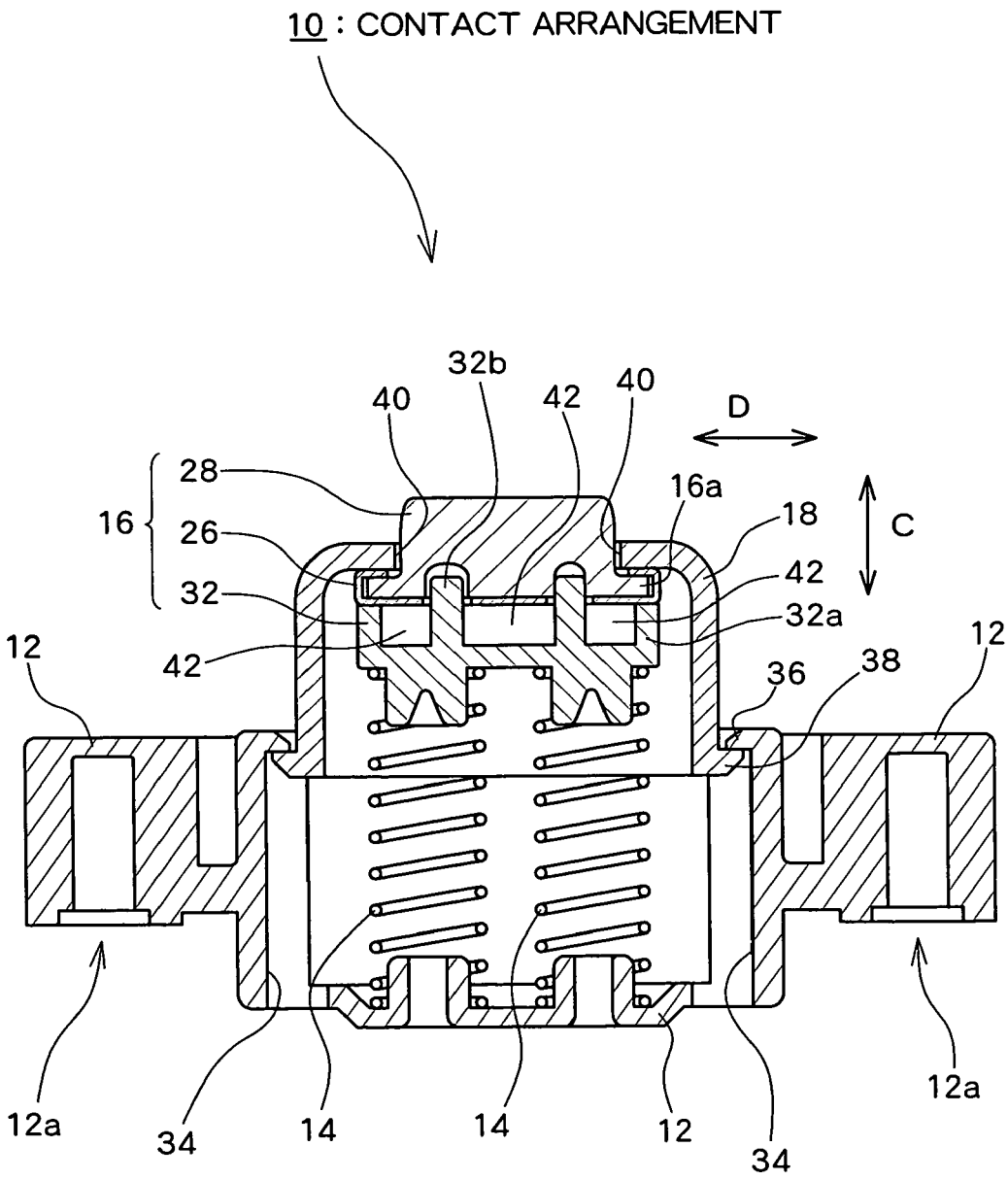
FIG. 3 is a sectional view of the contact arrangement taken along the line B—B of FIG. 2.

Referring to drawings, a preferred embodiment of this invention will be described below. FIG. 1 is an external view showing an example of a contact arrangement 10 according to this embodiment, FIG. 2 is a sectional view taken along the line A—A of FIG. 1, and FIG. 3 is a sectional view taken along the line B—B of FIG. 2.

The contact arrangement 10 includes a main body 12, an elastic member 14, a contact unit 16, an intermediate 18, and a wire 20. The contact arrangement 10 is used for forming an electrical conduction path between a first component 22 (such as, for example, a signal processor in an antenna for a vehicle window) and a second component 24 (such as, for example, a vehicle window) as an object to be contacted. In the example shown in FIGS. 1 to 3, the electrical conduction path is formed by electrically connecting a conductor pattern (not illustrated) of the first component 22, the wire 20, a metallic lead 26, an contact head 28, and a conductor pattern 30 of the second component 24, in that order.

The main body 12 is fixed onto the first component 22. In the example shown in FIGS. 1 to 3, the main body 12 is fixed onto the first component 22 using a tap screw (not illustrated) inserted into a threaded hole 12*a*. It is preferable that the main body 12 is made of an insulating material such as, for example, a nylon resin.

The intermediate 18 can freely make physical contact with or move away from the second component 24 within a predetermined range while being guided by a guiding segment provided in the main body 12. In this example, a guide hole 34 working as the guiding segment is formed in the main body 12 as shown in FIGS. 2 and 3. The guide hole 34 has a mouth at the end facing the second component 24 and a bottom surface at the other end, and extends along a direction almost perpendicular to an installation base of the first component 22, the direction as shown by an arrow C in FIG. 3, and which will hereafter be referred to as direction C or a vertical direction. In addition, the guide hole 34 has an almost oval cross section. The intermediate 18 can freely emerge from, and sink below the end surface of, the main body 12 opposing to the object to be contacted (the second component 24) while being guided by the guide hole 34.

Further, in this example, the guide hole 34 has an engaging lug 36, provided at the mouth (the open end) thereof, for protecting the intermediate 18 from falling off. On the other hand, another engaging lug 38 is attached to the bottom of the intermediate 18. The topmost position (the top dead center) of the intermediate 18 is defined by engagement between the engaging lugs 36 and 38 (the position illustrated in FIGS. 2 and 3). The lowermost position (the bottom dead center) of the intermediate 18 is located at the point where the intermediate 18 sinks until it reaches the bottom of the guide hole 34 or where the elastic member 14 lies in the lowest position.

The intermediate 18 is loosely fitted into the guide hole 34. In other words, an interstice is provided between an external wall of the intermediate 18 and an internal wall of the guide hole 34, allowing the intermediate 18 to freely move along a direction shown by an arrow D of FIG. 3 (hereinafter referred to as a direction D or a lateral direction). Further, the interstice is established so as to allow the intermediate 18 to tilt within a predetermined range of angles relative to an advance/retreat direction (an approximate direction C) when the intermediate 18 is inserted into the guide hole 34. The construction of the interstice and the effect of tilting of the intermediate 18 will be described below.

Further, the intermediate 18 is formed as a cylindrical member having an upper base wall and a side wall. The contact head 28 is loosely fitted into a through hole 40 formed as an opening in the upper base wall and protruded toward the second component 24 from the through hole 40. By engagement between side walls of the through hole 40 and the contact head 28, the intermediate 18 is linked to lateral movement of the contact unit 16. Therefore, a movable range of the contact unit 16 in the lateral direction is defined by the movable range of the intermediate 18.

Because there is also a predetermined interstice between an external wall of the contact head 28 and an internal wall of the through hole 40, the contact head 28 can freely move within the interstice along a direction perpendicular to an axis direction of the through hole 40 (the direction D if the contact head 28 is in its position shown in FIG. 3). Further, the interstice is established so as to allow the contact head 28 to tilt within a predetermined range of angles relative to the axis direction of the through hole 40 (the direction C if the contact head 28 is in its position shown in FIG. 3) in a state where the contact head 28 is inserted in the through hole 40. The configuration of this interstice and the effect of tilting of the contact head 28 will be described below.

The contact unit 16 is forced to move toward the second component 24 (i.e. along the vertical direction) by the elastic member 14 and pressed against the second component 24. In this example, the contact unit 16 includes the contact head 28, the metallic lead 26, and the insulator 32. The contact head 28 has a roughly flat planar contacting area at its top, and a flange 16*a* laterally protruding at the bottom thereof. By engagement between an upper surface of the flange 16*a* and an undersurface of the upper base of the intermediate 18, the intermediate 18 is linked to upward movement of the contact unit 16. Therefore, a range of upward movement of the contact unit 16 is regulated by the movable range of the intermediate 18. Because the contact arrangement 10, although it may tile slightly, is normally installed in an upright position, the first component 22 is basically located vertically lower, which causes the intermediate 18 to come to rest on the flange 16*a* due to the effect of gravity. As a result, movement of the intermediate 18 is further linked to downward movement of the contact unit 16.

In this example, the metallic lead 26 and the wire 20 are used as the electric conduction path as described above, and an effort is made to avoid using the elastic member (for example, a coil spring) 14 made of a metallic conductor as the electric conduction path, because use of the elastic member 14 made of a metallic conductor as the electric conduction path (in particular, in a case where the elastic member 14 is a coil spring) leads to inductance of the electric conduction path adversely affecting transmission characteristics of a high-frequency signal. Therefore, in this example, the elastic member 14 is isolated from the electric conduction path (consisting of the metallic lead 26 and the contact head 28 in this example) by the insulator 32.

In addition, when the distance between the electric conduction path and the elastic member 14 is relatively small, the high-frequency signal can leak through a route from the metallic lead 26 via the elastic member 14 to the ground electrode (not illustrated), which could also adversely affect the transmission characteristics. Therefore, in this example a sufficient distance between the electric conduction path (the metallic lead 26 in this example) and the elastic member 14 to prevent leakage of the high-frequency signal in the frequency band employed is secured by the insulator 32.

Figure 4:
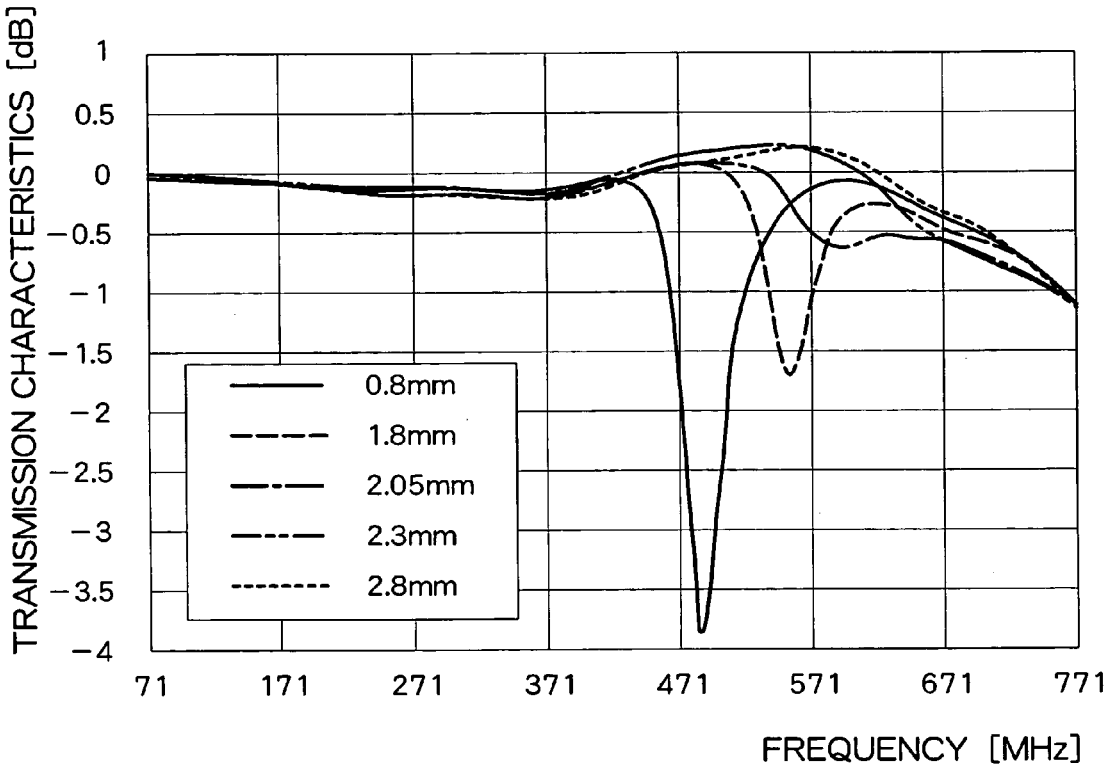
FIG. 4 is a graph showing the effect of improvement in signal transmission characteristics achieved when an insulator having the contact arrangement according to the present invention is provided.

FIG. 4 is a graph showing a relationship between frequencies and strengths of the signal transferred through the electric conduction path in the contact arrangement 10 with respect to each sampled distance between the electric conduction path and the elastic member 14 (i.e. the distance between the upper end of the elastic member 14 and the lower end of the metallic lead 26). As can be seen from FIG. 4, the strength of the signal decreases in a particular frequency range with respect to smaller distances, and the degree of a decrease in signal strength is minimized as the distance increases. From this, it can therefore be understood that transmission characteristics are improved to a greater extent when the distance is greater. The distance between the upper end of the elastic member 14 and the metallic lead 26 should be determined taking into account the area and the shape of the metallic lead 26, dielectric constants of associated components, the frequency band to be used, and the placement of surrounding metallic components and others. In addition, the outside diameter, the wire diameter, the number of turns, the material, and the length of the coil spring should be taken into account when determining the distance as used in this example.

Further, in this example, an arm 32*a* is formed to the insulator 32 as shown in FIGS. 2 and 3 to create a gap 42 between the upper end of the elastic element 14 and the lower end of the electric conduction path (the metallic lead 26). Because the dielectric constant of air is less than that of the insulator 32, formation of the gap 42 facilitates further reduction of the parasitic capacitance existing between the electric conduction path and the elastic member 14, which in turn brings about further improvement in transmission characteristics. It should be noted that although the gap 42 is created using the arm 32*a* in this example, it is possible to produce the same effect by forming a gap in the insulator 32.

In this example, the metallic lead 26, configured, for example, by forming a metal plate, has an arm 26*a* extending outward in the lateral direction (the direction shown by an arrow E in FIG. 2), and this arm 26 is connected to the wire 20. The wire 20 connected to the contact unit 16 is expanded and contracted by vertical movement of the contact unit 16, which might create a situation in which when the wire 20 is connected to the contact unit 16 at a place located inner than the elastic member 14, the wire 20 being folded and bended approaches the elastic member 14. With this in view, the contact unit 16 and the wire 20 are connected at a place located outward, in the lateral direction, of the side boundary of the elastic member 16, so that the wire 20 can be kept apart from the elastic member 14 to maintain low parasitic capacitance. The main body 12 is provided with a hooking bracket 12*b* for holding the wire 20 in order to additionally regulate the position of the wire 20 using the hooking bracket 12*b*. In this manner, interference with smooth vertical movement of the contact unit 16 by undesirable forces exerted onto the contact unit 16 is prevented.

Because the contact head 28 and the metallic lead 26 are fixed and positioned by a pin 32*b* of the insulator 32, the contact head 28, the metallic lead 26, and the insulator 32 integrally move as the contact unit 16 laterally and upwardly. Because the contact head 28 is, on the other hand, pressed down by the second component 24 or the intermediate 18 from above due to a reaction force against the upward force exerted from the elastic member 14, the contact head 28, the metallic lead 26, and the insulator 32 also integrally move downward.

The elastic member 14 is, in this example, configured by two coil springs placed in parallel and installed at a height lower than the free length of the coil springs in a state illustrated in FIG. 3. In other words, the state that the intermediate 18 is present in its uppermost position. The distance between the bottom of the main body and a contact surface of the object to be contacted (the surface of the conductor pattern 30) and the dimensions of each component of the contact arrangement 10 are determined so that, after contact is mad with the object to be contacted (the second component 24), the contact unit 16 is pressed down to thereby create a force acting in the same direction as an expanding direction of the elastic member 14, being the coil springs. This force becomes a source of contact pressure on the contact surface. The elastic member 14 may consist of just one, or of three or more coil springs, and may be configured by an elastic component (such as, for example, a leaf spring) other than the coil spring. It should be noted that the intermediate 18 is configured so as to engage with the contact unit 16, but not configured so as to receive the force from the elastic member 14.

Figure 5:
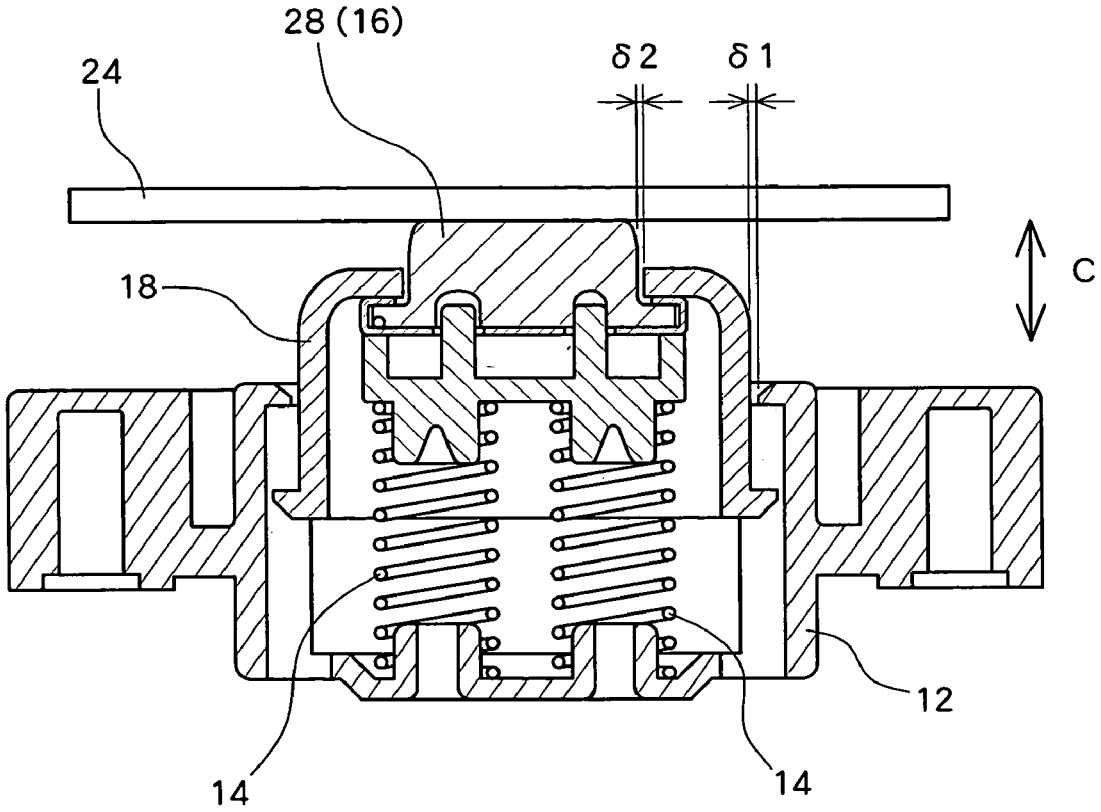
FIG. 5 shows an example condition of the contact arrangement of FIG. 1 touching an object to be contacted.
Figure 6:
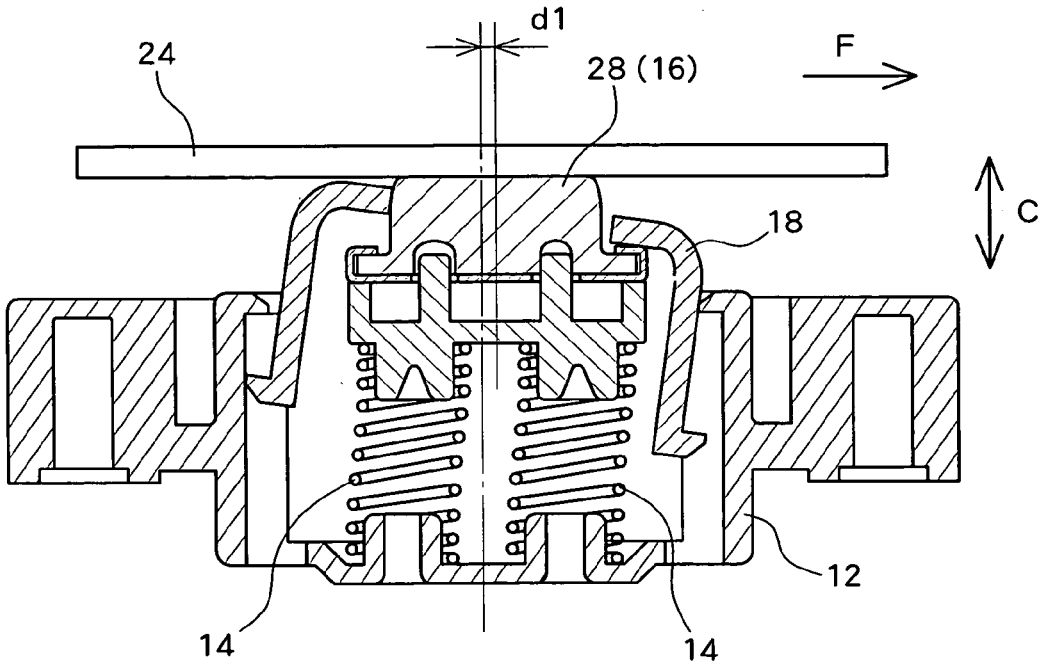
FIG. 6 shows another example condition of the contact arrangement of FIG. 1 touching the object to be contacted.
Figure 7:
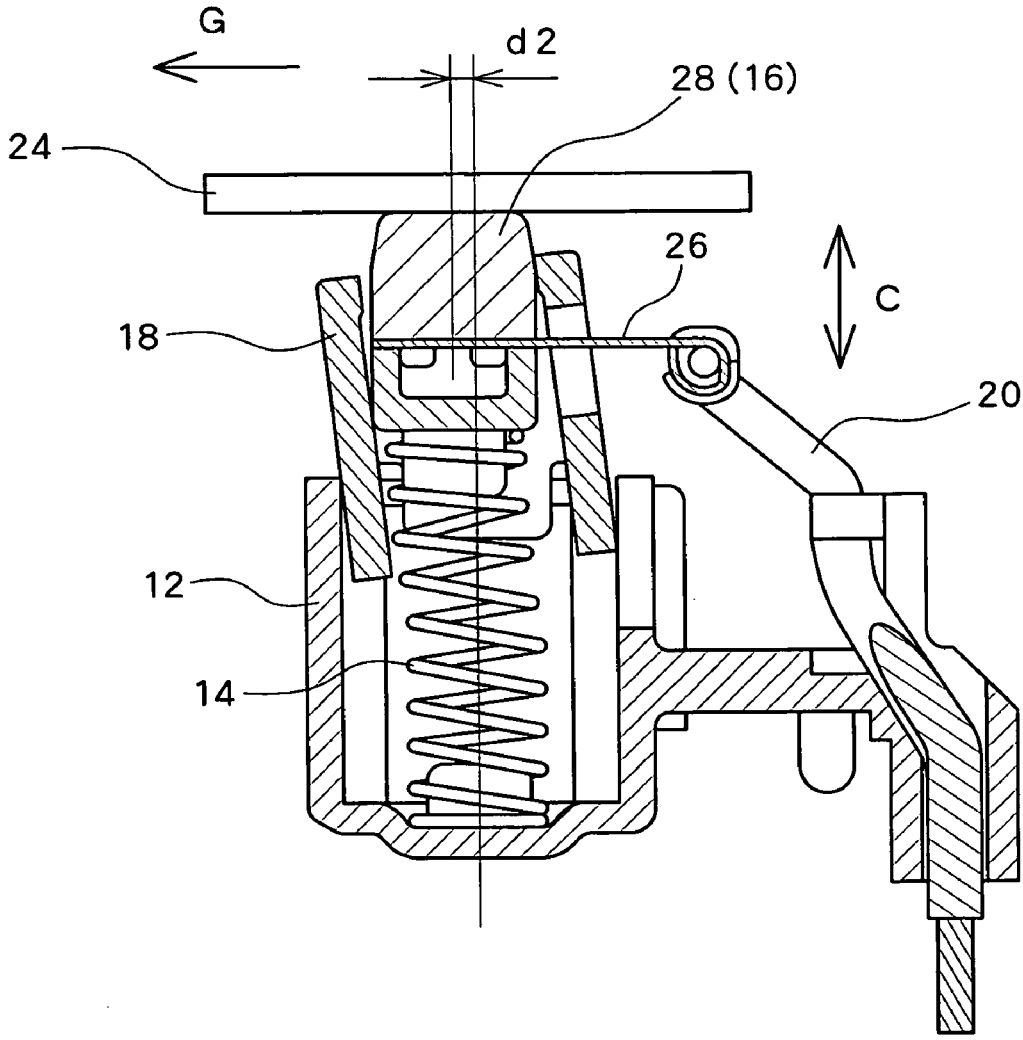
FIG. 7 shows still another example condition of the contact arrangement of FIG. 1 touching the object to be contacted.

FIGS. 5 to 7 shows internal layout and positional attitudes of components of the contact arrangement 10 in the implemented state (in which the contact arrangement 10 is attached to the first component 22, and the contact unit 16 presses the contacting surface of the second component 24 being the object to be contacted). Specifically, FIG. 5 shows the contact unit 16 pushed in along an almost vertical direction without being laterally offset from the object to be contacted, FIG. 6 also shows the contact unit 16 pushed in while being offset along a lateral direction (a direction F), and FIG. 7 shows the contact unit 16 pushed in while being offset along another lateral direction (a direction G).

When the contact unit 16 is pushed down along the almost vertical direction as shown in FIG. 5, the intermediate 18 is moved downward while maintaining its upright position shown in FIG. 3 without tilting relative to a guide direction (a direction C) defined by the guide hole 34. As can be seen from FIG. 5, because the intermediate 18 is inserted between the contact unit 16 and the main body 12, the movable range of the contact unit 16 in the lateral direction (the direction C) is defined by an overlapping length between the intermediate 18 and the guide hole 34. In other words, the structure of the intermediate 18 affects the movable range of the contact unit 16. If an attempt to extend the movable range of the contact unit 16 is made in a conventional structure in which the contact unit 16 is directly guided by the guide hole 34 without the intermediate 18, it would be necessary to make the contact unit 16 larger. On the contrary, provision of the intermediate 18 as described in this embodiment makes it possible to extend the travel distance of the contact unit 16 without increasing the size of the contact unit 16. Such a structure is effective at trying to minimize the size of the contact unit 16, desirable when the contact unit 16 may be made of a particular, often expensive material, or in terms of the spring constant of the elastic member 14. For example, if the contact head 28 is made of an electrically conductive rubber, it is desirable, in terms of durability, to form the contact head 28 in a larger block shape which is less prone to stress concentrations. Because the structure including the intermediate 18 has a high degree of flexibility in designing of the shape of the contact head 28 (the contact unit 16), the structure is preferably adopted when the conductive rubber is used as the contact head 28.

The intermediate 18 can be offset laterally by the distance of a gap $\delta 1$ in the guide hole 34, while maintaining its strait orientation without tilting. The contact head 28, on the other hand, can also be offset laterally by the distance of a gap δ2 between the side wall of the contact head 28 and the side wall of the through hole 40 while similarly maintaining its strait position without tilting. In other words, the amount of lateral movement of the contact unit 16 in that position is defined by the sizes of the gaps δ1 and δ2.

On the other hand, when the contact unit 16 is greatly offset (by the amount of offsetting dl) along the lateral direction (the direction F) as shown in FIG. 6, the intermediate 18 tilts relative to the direction C, which causes the contact unit 16 to be tilted against the intermediate 18. As a result, the contact unit 16 can move a relatively long distance (longer than that achieved in the case shown in FIG. 5) along the lateral direction while maintaining its position touching the object to be contacted on the contact surface of an almost flat plane. This long-distance movement is realized by configuring the intermediate 18 so as to laterally engage with the contact unit 16 and allowing the intermediate 18 to tilt against the guide hole 34 as well as allowing the contact unit 16 to tilt against the intermediate 18. With such a configuration, the contact surfaces of both the contact head 28 and the object to be contacted can be offset from each other to a greater extent than heretofore possible, while maintaining their contact. As a result, resistance to wear is improved and any increase in contact resistance due to unilateral contact is prevented.

Further, to increase the amount of tilting of the intermediate 18 against the guide segment (the guide hole 34), i.e. the angle of tilting relative to the direction C, the interstice between the side edge of the guide hole 34 and the external wall of the intermediate 18 may preferably be broadened toward the second component 24 (upward). In this example, the intermediate 18 tapers down toward the tip. When the width of the gap is kept constant, the amount of tilting of the intermediate 18 decreases as the intermediate 18 is pressed deeper in toward the first component 22, which leads to reduction in the amount of offsetting in the lateral direction (the direction F) of the contact unit 16. According to this embodiment, in the above-described structure, the amount of tilting of the intermediate 18 is secured, even after the intermediate 18 is pressed in, to thereby increase the lateral offset of the contact unit 16.

It should be noted that, in this embodiment, surface contact between the contact unit 16 and the object to be contacted is retained, even when the object to be contacted (the second component 24) is not placed in parallel with the first component 22. The tolerance range of tilting of the object to be contacted is determined by the sum of the amount of tilting of the intermediate 18 relative to the main body 12 and the amount of tilting of the intermediate 18 relative to the contact unit 16.

Further, when the contact unit 16 is largely offset (by the amount d2) along the lateral direction (the direction G), the intermediate 18 tilts toward the direction G, while the contact unit 16 tilts against the intermediate 18. As a result of the tilting, the contact unit 16 can move laterally while maintaining its condition touching the object to be contacted on the almost flat contact surface. To increase the amount of offset along the direction G, the intermediate 18 may preferably be formed in a shape which tapers down toward the tip.

Figure 8:
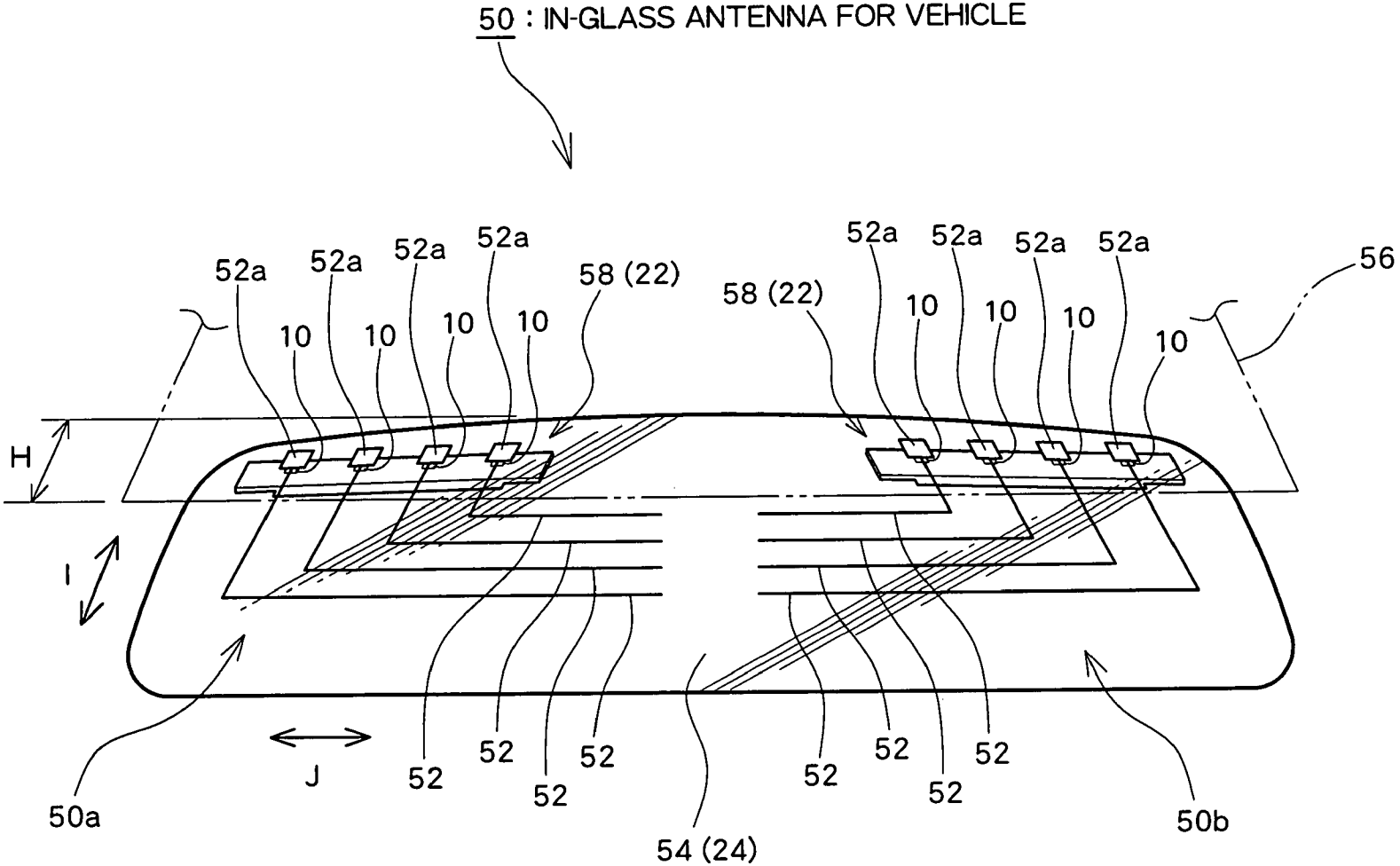
FIG. 8 shows an example structure of the main part of an in-glass antenna for a vehicle using the contact arrangement according to another embodiment of this invention.
Figure 9:
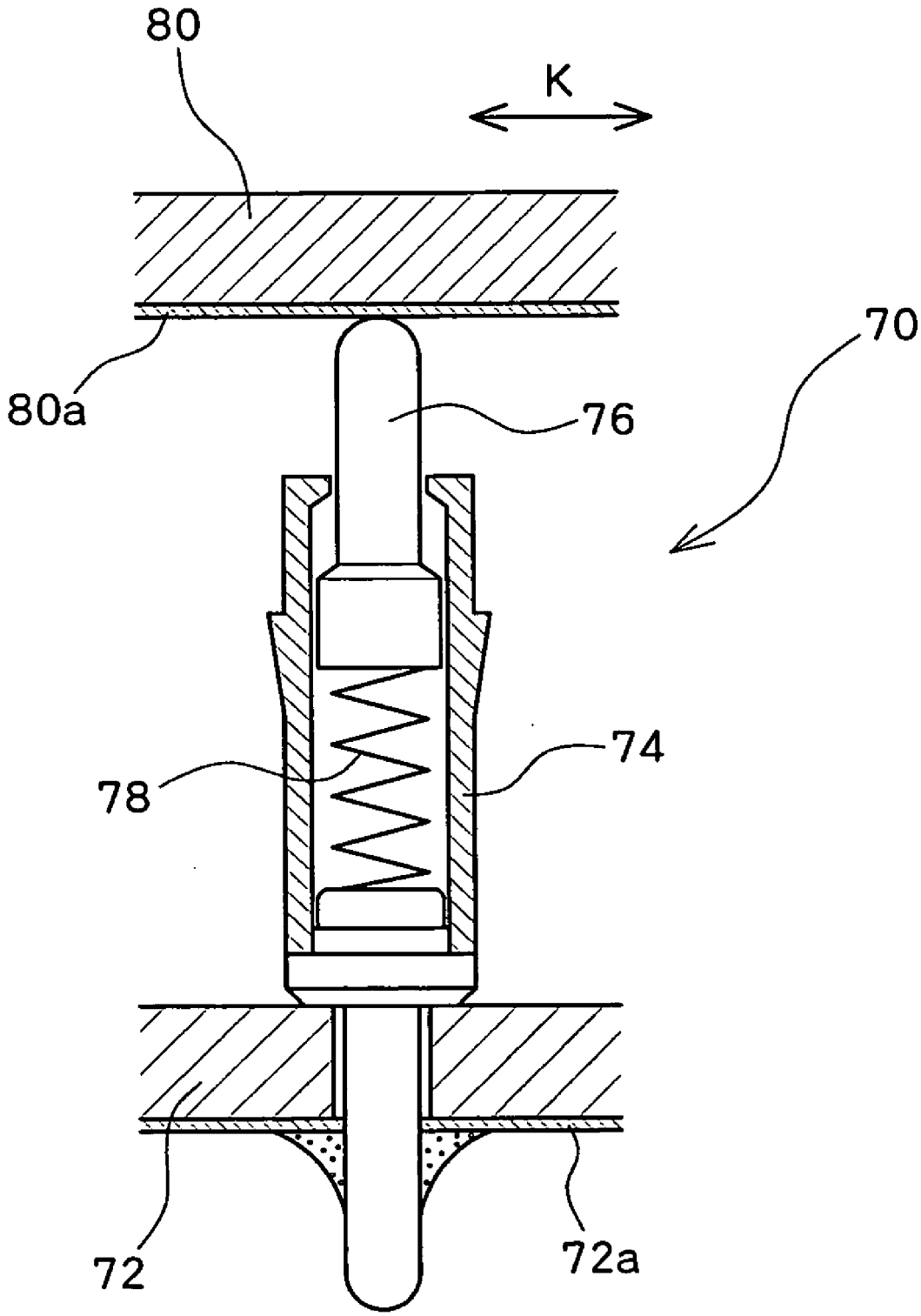
FIG. 9 shows a related-art contact arrangement.

FIG. 8 is a drawing schematically illustrating an example structure of an in-glass antenna 50 for a vehicle using the contact arrangement 10 according to this embodiment. Antenna elements 52 of the in-glass antenna 50 for a vehicle are attached to the interior side of, for example, a rear window glass 54 of the vehicle by means of printing or the like. Each one end of the antenna elements 52 is extended to an overlap H between a roof panel 56 and the rear window glass 54 of the vehicle. A substrate support base 58 holding a processing circuit, such as for example, an amplifier, for processing a signal received by the antenna elements 52 is fixed by fixtures, such as, for example, bolts, on the roof panel 56. The overlap H is covered with a component, such as a cover plate, to be hidden from view.

The substrate support base 58 has the processing circuit, such as an amplifier, formed thereon and the contact arrangement 10 connected to terminal contact points 52*a* each formed at an end of the antenna elements 52. Accordingly, the substrate support base 58 is fixed on the roof panel 56 at a predetermined position where the contact arrangement 10 contacts the terminal contact points 52*a* when pressed, to thereby establish electric continuity between the antenna elements 52 and the internal circuit of the substrate support base 58. To establish diversity, a two-party-line system achieved by antenna units 50*a* and 50*b* having substantially the same function is adopted in FIG. 8. The number and the shape of the antenna elements 52 are not limited to those illustrated in the figure, but may be selected as appropriate according to its function and other features. It should be noted that, in the example shown in FIG. 8, the substrate support base 58 corresponds to the first component 22 described above, the rear window glass 54 corresponds to the second component 24, i.e. the object to be contacted, and the terminal contact points 52*a* correspond to the conductor pattern 30.

The in-glass antenna 50 for a vehicle having the above-described structure is constructed by mounting the substrate support base 58, having the contact arrangement 10 placed thereon, on the roof panel 56, and then fixing the rear window glass 54 in a predetermined position. In the fixing procedure, the rear window glass 54 is often moved to finely adjust the placement location along the surface of the rear window glass 54, in directions I, J, or the like indicated in FIG. 8. Here, because the contact unit 16 of the contact arrangement 10 is pushed in by a predetermined degree at the time when the rear window glass 54 which is the object to be contacted is mounted on the vehicle, the rear window glass 54 will inevitably make physical contact with the contact arrangement 10 before reaching the proper position on the vehicle. For this reason, the rear window glass 54 is moved along the above-described direction (which is the lateral direction for the contact arrangement 10) while the contact arrangement 10 is contacting the terminal contact points 52*a*. As described above, the contact arrangement 10 according to this embodiment has features that abrasion is sufficiently prevented, and that any increase in contact resistance due to unilateral contact is suppressed, even when the contact unit 16 (the contact head 28) and the second component 24 are laterally shifted while maintaining their surface contact. These features are extremely advantageous to the contact arrangement 10 for the in-glass antenna 50 for a vehicle constructed by the above-described procedure.

While the present invention has been described as related to the preferred embodiment, the invention is not limited to the specific examples of the embodiment, and it is to be understood that changes and variations may be made without departing from the spirits or scope of the following claims.

What is claimed is:

1. A contact arrangement for a high-frequency circuit comprising:

a main body;

an elastic member installed inside said main body;

a contact head made of a conductor and pressed by a force exerted from said elastic member against an object to be contacted;

an insulator inserted between said elastic member and said contact head to break electric continuity between said elastic member and said contact head, and a wire physically connected to said contact head to constitute a part of an electric conduction path, wherein electric continuity with the object to be contacted is established by said wire and said contact head and not said elastic member.

2. A contact arrangement for a high-frequency circuit according to claim 1, wherein an arm or a cavity is formed to said insulator to provide a gap between said elastic member and said contact head.

3. A contact arrangement for a high-frequency circuit according to claim 1 or 2, further comprising:

a metallic lead inserted between said insulator and said contact head to be electrically continuous with said contact head, and including an arm for wiring which extends outward along a direction intersecting an axial direction of said elastic member, wherein said wire is connected to said arm for wiring at a place located outer than side edges of said contact head and said elastic member.

4. A contact arrangement used for an antenna for a vehicle window comprising:

a main body;

an elastic member installed inside said main body;

a contact head made of a conductor and pressed by a force exerted from said elastic member against a contacting area of an antenna element attached to the vehicle window;

an insulator inserted between said elastic member and said contact head to break electric continuity between said elastic member and said contact head, and a wire physically connected to said contact head to constitute a part of an electric conduction path, wherein electric continuity with the contacting area is established by said wire and said contact head rather than said elastic member.

5. A method of installing, in a vehicle, a contact arrangement used for an antenna for a vehicle window, the contact arrangement including a main body, an elastic member installed inside said main body, a contact head made of a conductor and pressed by a force exerted from said elastic member against a contacting area of an antenna element attached to the vehicle window;

an insulator inserted between said elastic member and said contact head to break electric continuity between said elastic member and said contact head, and a wire connected to said contact head to constitute a part of an electric conduction path, the contact arrangement in which electric continuity with the contacting area is established by said wire and said contact head rather than said elastic member, the method comprising the steps of:

attaching said contact arrangement to a vehicle panel, and fixing the vehicle window onto said vehicle panel in such a manner that said contact head of said contact arrangement contacts said contacting area of said antenna element attached to the vehicle window.

* * * * *